US010995910B2

(12) United States Patent
Vovard et al.

(10) Patent No.: US 10,995,910 B2
(45) Date of Patent: May 4, 2021

(54) PROCESS FOR EXPANSION AND STORAGE OF A FLOW OF LIQUEFIED NATURAL GAS FROM A NATURAL GAS LIQUEFACTION PLANT, AND ASSOCIATED PLANT

(71) Applicant: TECHNIP FRANCE, Courbevoie (FR)

(72) Inventors: Sylvain Vovard, Louveciennes (FR); Vincent Tirilly, Carrieres sur seine (FR)

(73) Assignee: TECHNIP FRANCE, Courbevoie (FR)

( * ) Notice: Subject to any disclaimer, the term of this patent is extended or adjusted under 35 U.S.C. 154(b) by 0 days.

(21) Appl. No.: 15/744,338

(22) PCT Filed: Jul. 12, 2016

(86) PCT No.: PCT/EP2016/066544
§ 371 (c)(1),
(2) Date: Jan. 12, 2018

(87) PCT Pub. No.: WO2017/009341
PCT Pub. Date: Jan. 19, 2017

(65) Prior Publication Data

US 2018/0202610 A1 Jul. 19, 2018

(30) Foreign Application Priority Data

Jul. 13, 2015 (FR) ..... 15 56656

(51) Int. Cl.
*F25J 3/02* (2006.01)
*F17C 9/04* (2006.01)
(Continued)

(52) U.S. Cl.
CPC ..... *F17C 9/04* (2013.01); *F25J 1/004* (2013.01); *F25J 1/0022* (2013.01); *F25J 1/0025* (2013.01);
(Continued)

(58) Field of Classification Search
CPC ..... F25J 3/0214; F25J 3/0615; F25J 2210/62; F25J 3/0219; F25J 3/004; F25J 2223/0161; F25J 2223/033; F17C 9/04
See application file for complete search history.

(56) References Cited

U.S. PATENT DOCUMENTS 3,331,214 A 7/1967 Proctor et al.
3,581,511 A 6/1971 Peck
(Continued)

FOREIGN PATENT DOCUMENTS

CN 85103725 A 11/1986
CN 1481495 A 3/2004
(Continued)

OTHER PUBLICATIONS

Prior Art Search dated Apr. 25, 2014.
(Continued)

*Primary Examiner* — Brian M King
(74) *Attorney, Agent, or Firm* — Locke Lord LLP; Alan B. Clement

(57) ABSTRACT

The process comprises the following steps: mixing a gaseous stream of flash gas and a gaseous stream of boil-off gas to form a mixed gaseous flow; compressing the mixed gaseous flow in at least one compression apparatus to form a flow of compressed combustible gas; withdrawing a bypass flow in the flow of compressed combustible gas; compressing the bypass flow in at least one downstream compressor; cooling and expanding the compressed bypass flow; reheating at least a first stream derived from the expanded bypass flow in at least one downstream heat exchanger, reintroducing the first reheated stream in the mixed gaseous flow upstream from the compression apparatus.

14 Claims, 6 Drawing Sheets

(51) Int. Cl.
*F25J 1/00* (2006.01)
*F25J 1/02* (2006.01)

(52) U.S. Cl.
CPC ..... *F25J 1/0037* (2013.01); *F25J 1/0042* (2013.01); *F25J 1/0208* (2013.01); *F25J 1/0219* (2013.01); *F25J 1/0264* (2013.01); *F25J 1/0271* (2013.01); *F25J 1/0278* (2013.01); *F25J 1/0288* (2013.01); *F25J 3/0209* (2013.01); *F25J 3/0214* (2013.01); *F25J 3/0233* (2013.01); *F25J 3/0257* (2013.01); *F17C 2221/033* (2013.01); *F17C 2223/0161* (2013.01); *F17C 2223/033* (2013.01); *F17C 2265/022* (2013.01); *F17C 2265/034* (2013.01); *F17C 2270/0136* (2013.01); *F25J 2200/02* (2013.01); *F25J 2200/70* (2013.01); *F25J 2200/76* (2013.01); *F25J 2205/04* (2013.01); *F25J 2210/06* (2013.01); *F25J 2215/04* (2013.01); *F25J 2220/62* (2013.01); *F25J 2240/30* (2013.01); *F25J 2245/90* (2013.01); *F25J 2270/04* (2013.01); *F25J 2270/88* (2013.01)

(56) References Cited

U.S. PATENT DOCUMENTS

| | | | | |
|---|---|---|---|---|
| 3,690,114 | A | 9/1972 | Swearingen et al. | |
| 3,857,245 | A | 12/1974 | Jones | |
| 4,229,195 | A | 10/1980 | Förg | |
| 4,435,198 | A * | 3/1984 | Gray | F25J 1/0022 62/622 |
| 4,689,962 | A | 9/1987 | Lofredo | |
| 5,137,558 | A | 8/1992 | Kilner | |
| 2004/0065113 | A1 | 4/2004 | Paradowski | |
| 2007/0256450 | A1 | 11/2007 | Rogers | |
| 2008/0066492 | A1 | 3/2008 | Buijs et al. | |
| 2008/0066493 | A1 * | 3/2008 | Buijs | F25J 3/0209 62/620 |
| 2010/0139316 | A1 | 6/2010 | Pettitt | |
| 2010/0139317 | A1 | 6/2010 | Teitelbaum | |
| 2010/0263407 | A1 | 10/2010 | Paradowski et al. | |
| 2011/0094262 | A1 | 4/2011 | Turner et al. | |

FOREIGN PATENT DOCUMENTS

| | | | |
|---|---|---|---|
| CN | 2013463934 | U | 3/2014 |
| DE | 1947539 | A1 | 4/1970 |
| DE | 102010062044 | A1 | 5/2012 |
| DE | 102010062050 | A1 | 5/2012 |
| EP | 153649 | A2 | 9/1985 |
| EP | 711967 | A2 | 5/1996 |
| EP | 1131581 | A1 | 9/2001 |
| EP | 1913117 | A1 | 4/2008 |
| EP | 1941218 | A1 | 7/2008 |
| EP | 1959217 | A2 | 8/2008 |
| EP | 2265854 | A1 | 12/2010 |
| EP | 2334998 | A2 | 6/2011 |
| EP | 2513267 | A1 | 10/2012 |
| EP | 2690274 | A1 | 1/2014 |
| EP | 2693035 | A1 | 2/2014 |
| GB | 1288762 | A | 9/1972 |
| GB | 1310707 | A | 3/1973 |
| GB | 1471404 | A | 4/1977 |
| JP | H10019199 | A | 1/1998 |
| JP | 2001132899 | A | 5/2001 |
| JP | 2006348080 | A | 12/2006 |
| JP | 2008506026 | A | 2/2008 |
| JP | 2009030675 | A | 2/2009 |
| JP | 2009512831 | A | 3/2009 |
| KR | 20110042910 | A | 4/2011 |
| KR | 20120030472 | A | 3/2012 |
| KR | 20120058263 | A | 6/2012 |
| WO | 0025061 | A1 | 5/2000 |
| WO | 2006/135363 | A1 | 12/2006 |
| WO | 2007/011155 | A1 | 1/2007 |
| WO | 2009/126604 | A1 | 10/2009 |
| WO | 2010010406 | A2 | 1/2010 |
| WO | 2011073931 | A1 | 6/2011 |

OTHER PUBLICATIONS

PCT Rapport de Recherche Internationale dated Oct. 12, 2016 (Form PCT/ISA/210) (dated Jan. 2015) and Rapport de Recherche Preliminaire dated May 13, 2016.
Sylvain Vovard et al., "Nitrogen Removal on LNG Plant—Select the Optimum Scheme," Gas Processors Association—Europe (XP007921112) pp. 1-11 dated May 1, 2011.
Chinese Office Action issued in Chinese Application No. 201680051218.7 dated Sep. 9, 2019 and English translation thereof.
Japanese Office Action dated Jul. 14, 2020 issued in JP Application No. 2018-501278 and English translation.

* cited by examiner

PROCESS FOR EXPANSION AND STORAGE OF A FLOW OF LIQUEFIED NATURAL GAS FROM A NATURAL GAS LIQUEFACTION PLANT, AND ASSOCIATED PLANT

This application is a National Stage application of international Patent Application Number, PCT/EP2016/066544, filed on Jul. 12, 2016, which claims priority to FR 15 56656, filed Jul. 13, 2015, the entire contents of which are incorporated herein by reference.

The present invention relates to a process for expansion and storage of a flow of liquefied natural gas from a natural gas liquefaction plant, comprising the following steps:

- flash expanding of the flow of liquefied natural gas in an expansion device to form a flow of expanded liquefied natural gas;
- bringing the flow of expanded liquefied natural gas into a flash end capacitor;
- recovering, at the bottom of the flash end capacitor, a liquid stream of liquefied natural gas;
- conveying the liquid stream of liquefied natural gas into at least one liquefied natural gas tank;
- withdrawing, at the head of the flash end capacitor, a gaseous stream of flash gas;
- recovering, at the head of the liquefied natural gas tank, a gaseous stream of boil-off gas;
- mixing the gaseous stream of flash gas and the gaseous stream of boil-off gas to form a mixed gaseous flow;
- compressing the mixed gaseous stream in at least one compression apparatus to form a flow of compressed combustible gas.

Such a method is in particular intended to be carried out in floating plants for producing liquefied natural gas, or in land-based liquefaction plants, with a reduced bulk.

In the liquefied natural gas production plants that are currently in operation, the natural gas is condensed and sub-cooled at high pressure, before undergoing a flash expansion to atmospheric pressure. The liquefied natural gas thus obtained can be stored at atmospheric pressure and at a cryogenic temperature, typically of about −160° C.

The expansion is done either directly at the liquefied natural gas storage tank, or in a dedicated unit, for example a flash gas recovery unit.

In such a unit, the vapor generated by the expansion is recovered, then is compressed in a dedicated compressor to form a flow of combustible gas, or to be recycled within the liquefaction train.

Furthermore, another stream of vapor is generated in the liquefied natural gas storage tank, due to the pressure difference between a liquid directly derived from the expansion and that present in the storage tank and/or due to the reheating of the liquefied natural gas when it is transported toward the tank.

A gaseous stream of boil-off gas taken from the tank is therefore recovered and is compressed in another dedicated compressor, to form a combustible gas stream or to be recycled within the unit, in particular when the unit is a floating unit.

Such a method is not fully satisfactory, in particular in a floating environment. Indeed, the limitation of the method requires several separate compressors, often at least three compressors, which is particularly cumbersome and heavy, and increases the fixed and variable costs of the plant.

To offset this problem, DE102010062050 describes a method in which the gaseous stream of flash gas and the gaseous stream of boil-off gas are mixed, then are jointly compressed in a shared compressor, to form the flow of combustible gas.

Such a method decreases the bulk of the plant and reduces the implementation costs. However, the method is not fully optimized in terms of yield and recovery of the liquefied natural gas.

One aim of the invention is therefore to obtain a particularly compact and cost-effective method for recovering flash gases and boil-off gases derived from a natural gas liquefaction plant by using one or several compressors dedicated to the two functions.

To that end, the invention relates to a method of the aforementioned type, comprising the following steps:

- withdrawing a bypass flow in the flow of compressed combustible gas;
- compressing the bypass flow in at least one downstream compressor to form a compressed bypass flow;
- cooling the compressed bypass flow;
- expanding the compressed bypass flow to form an expanded bypass stream;
- reheating at least a first stream derived from the expanded bypass flow in at least one downstream heat exchanger,
- reintroducing the first reheated stream in the mixed gaseous flow and/or in at least one of the gaseous stream of boil-off gas and the gaseous stream of flash gas, upstream from the compression apparatus.

According to specific embodiments, the process according to the invention comprises one or more of the following features, considered alone or according to any technically possible combination(s):

- the at least partially liquid expanded bypass flow is introduced into a downstream separation flask, the method comprising the following steps:
  - withdrawing, at the head of the downstream separation flask, the first gaseous stream, and reintroducing the first stream in the mixed gaseous flow and/or in at least one of the gaseous stream of boil-off gas and the gaseous stream of flash gas, upstream from the compression apparatus,
- recovering, at the bottom of the downstream separation flask, a second liquid bypass stream, and introducing the liquid bypass stream into the expanded liquefied natural gas flow, upstream from the flash end capacitor;
- the entire expanded bypass flow constitutes the first stream;
- the compressed bypass flow derived from the downstream compressor is introduced into the downstream heat exchanger to be placed in a heat exchange relationship with the first stream;
- the boil-off gas stream is introduced into the downstream heat exchanger to be placed in a heat exchange relationship with the first stream;
- it comprises the following steps:
  - providing a flow of treated natural gas intended to be liquefied;
  - introducing at least a first part of the flow of treated natural gas into the downstream heat exchanger to be placed in a heat exchange relationship with the first stream;
  - at least partially liquefying the first part of the flow of treated natural gas into the downstream heat exchanger by heat exchange with the first stream;
- it comprises introducing the first part of the flow of liquefied treated natural gas into the flow of expanded liquefied natural gas derived from the expansion device, upstream from a flash end capacitor;

it comprises the following steps:

separating the flow of treated natural gas into the first part of the flow of treated natural gas and a second part of the flow of treated natural gas;

introducing at the second part of the flow of treated natural gas into an additional heat exchanger, to be placed in a heat exchange relationship with the stream of flash gas;

liquefying the second part of the flow of treated natural gas in the additional heat exchanger by heating the stream of flash gas;

introducing the second part of the flow of liquefied treated natural gas into the flow of expanded liquefied natural gas derived from the expansion device, upstream from the flash end capacitor;

it also comprises the following steps:

tapping a recirculation flow into the flow of compressed gas;

liquefying at least part of the recirculation flow in the downstream heat exchanger by heat exchange with the first stream;

the flash end capacitor is a flash end separation flask or a flash end distillation column;

the expansion device comprises a dynamic expansion turbine;

the molar flow rate of the first part of the flow of treated natural gas is less than 10% of the molar flow rate of the flow of expanded liquefied natural gas derived from the expansion device.

The invention also relates to a plant for the expansion and storage of a flow of liquefied natural gas from a natural gas liquefaction plant, comprising:

an expansion device capable of performing a flash expansion of the flow of liquefied natural gas to form a flow of expanded liquefied natural gas;

a flash end capacitor capable of receiving the flow of expanded liquefied natural gas coming from the expansion device;

an assembly for recovering, at the bottom of the flash end capacitor, a liquid stream of liquefied natural gas;

at least one liquefied natural gas tank and an assembly for conveying the liquid stream of liquefied natural gas into the liquefied natural gas tank;

an assembly for withdrawing, at the head of the flash end capacitor, a gaseous stream of flash gas;

an assembly for recovering, at the head of the liquefied natural gas tank, a gaseous stream of boil-off gas;

an assembly for mixing the gaseous stream of flash gas and the gaseous stream of boil-off gas to form a mixed gaseous flow;

at least one compression apparatus able to compress the mixed gaseous flow to form a flow of compressed combustible gas, characterized by:

an assembly for withdrawing a bypass flow in the flow of compressed combustible gas;

at least one downstream compressor for compressing the bypass flow and forming a compressed bypass flow;

a downstream heat exchanger for cooling the compressed bypass flow to form an expanded bypass stream;

a device for at least partially expanding and liquefying the compressed bypass flow;

an assembly for introducing at least a first stream derived from the expanded bypass flow in the downstream heat exchanger, to allow reheating of the first stream, an assembly for reintroducing the first reheated stream in the mixed gaseous flow and/or in at least one of the gaseous stream of boil-off gas and the gaseous stream of flash gas, upstream from the compression apparatus.

According to specific embodiments, the installation according to the invention comprises one or more of the following features, considered alone or according to any technically possible combination(s):

the first stream consists of the entire expanded bypass flow;

it comprises:

a downstream separation flask, an assembly for withdrawing, at the head of the downstream separation flask, the first stream as a gas, and reintroducing the first stream in the mixed gaseous flow and/or in at least one of the gaseous stream of boil-off gas and the gaseous stream of flash gas, upstream from the compression apparatus.

an assembly for recovering, at the bottom of the downstream separation flask, a second liquid bypass stream, and introducing the liquid bypass stream into the expanded liquefied natural gas flow, upstream from the flash end separation flask;

the downstream heat exchanger is capable of placing in a heat exchange relationship the first stream, and at least part of a flow of treated gas intended to be liquefied;

it comprises:

an assembly for tapping a recirculation flow from the flow of compressed gas;

an assembly for introducing at least part of the recirculation flow in the downstream heat exchanger to liquefy it at least partially in the downstream heat exchanger.

The invention will be better understood upon reading the following description, provided solely as an example, and in reference to the appended drawings, in which.

Hereinafter, the same references will be used to designate a flow circulating in a pipe and the pipe that transports it. Furthermore, the terms "upstream" and "downstream" are to be understood generally relative to the normal flow direction of a fluid.

Furthermore, unless otherwise indicated, the percentages are molar percentages and the pressures are given in absolute bars.

The additional turbines that are described drive compressors, but may also drive variable-frequency electric generators, the produced electricity of which can be used in the network via a frequency converter.

The flows having a temperature higher than ambient temperature are described as being cooled by air coolers. Alternatively, it is possible to use water exchangers, for example with freshwater or seawater.

The ambient temperature prevailing around the plant is not significant with respect to the invention and may in particular be comprised between 15° C. and 35° C.

Figure 1:
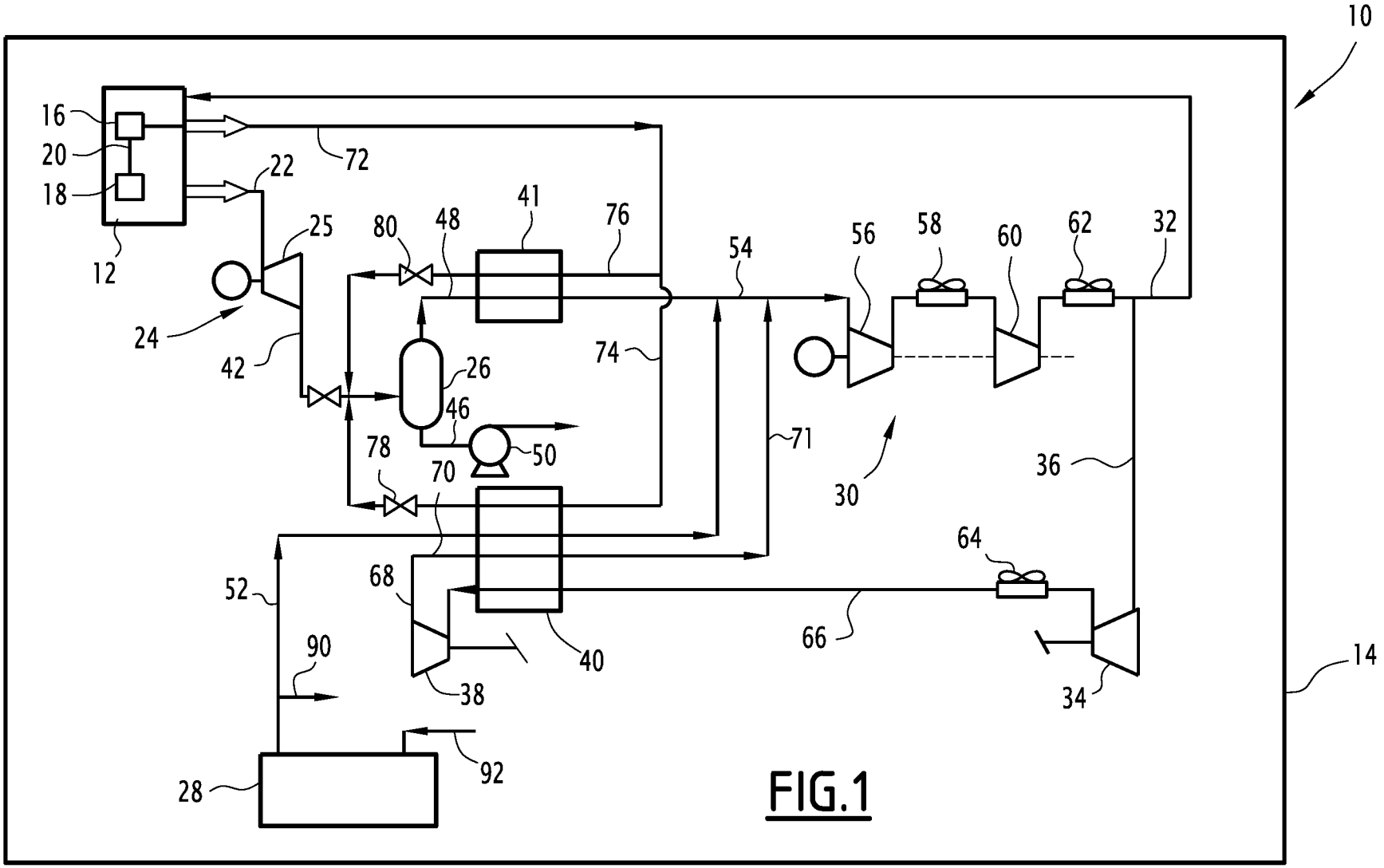
FIG. 1 is a block diagram of a first plant intended for the implementation of a first method according to the invention.

A first plant 10 for the expansion and storage of a flow of liquefied natural gas derived from a natural gas liquefaction plant 12 is illustrated schematically by FIG. 1.

The plants 10, 12 are advantageously carried by a support 14 located on the surface of an expanse of water, such as a sea, lake, ocean or river. The support 14 is for example a floating barge and constitutes a floating liquid natural gas (FLNG) liquefaction unit.

The liquefaction plant 12 is not described here in detail. In a known manner, if includes a treatment unit 16 for the natural gas, able to produce a treated gas with no components that could solidify during liquefaction, and a liquefaction unit 18 for the treated gas, comprising at least one system (not shown) for cooling, liquefaction, and sub-cooling of the treated gas 20, able to produce a flow 22 of pressurized liquefied natural gas.

The expansion and storage plant 10 includes an expansion device 24 for the flow of pressurized liquefied natural gas 22, here comprising a dynamic expansion turbine 25 and a flash end capacitor, in this particular example a flash end separation flask 26. It also includes at least one liquefied natural gas recovery tank 28, and a compression apparatus 30, able to recover and compress both the flash gas derived from the capacitor 26 and the boil-off gas derived from the or each tank 28, the form a flow of compressed combustible gas 32.

According to the invention, the plant 10 further includes a downstream compressor 34, intended to compress a bypass flow 38 withdrawn from the flow of compressed combustible gas 32, and at least one dynamic expansion turbine 38, able to expand the bypass flow 38.

In the example shown in FIG. 1, the plant 10 further includes a downstream heat exchanger 40 and an additional heat exchanger 41 intended to liquefy at least part of the treated gas 20, using the cold produced during the dynamic expansion of the bypass flow 36 in the turbine 38.

Alternatively or additionally, as described below in FIG. 3, the exchangers 40 and 41 are intended for at least partial cooling and liquefaction of part of the bypass flow 36, when an excess of flash gas and/or boil-off gas is present in the flow of compressed combustible gas 32.

A first method according to the invention for the expansion and storage of the flow of liquefied natural gas 22, implemented in the plan 10, will now be described.

Initially, a flow of pressurized liquefied natural gas 22 is produced by the plant 12.

The flow of liquefied natural gas 22 has a pressure for example exceeding 60 bars, and could be comprised between 40 bars and 80 bars.

The flow 22 is sub-cooled. The temperature of the flow of liquefied natural gas 22 is typically below −150° C., but may be comprised between −140° C. and −160° C.

The flow 22 may advantageously have a molar methane content greater than 80%, and a molar $C_4^+$ content below 5%.

The molar flow rate of the flow of liquefied natural gas 22 is for example greater than 10,000 kmol/h.

The flow of liquefied natural gas 22 is conveyed to the dynamic expansion turbine 25 of the expansion device 24 to undergo a flash expansion therein and form a flow 42 of expanded liquefied natural gas.

The pressure of the flow of expanded liquefied natural gas 42 is for example below 7 bars, in particular comprised between 6 bars and 12 bars.

The expansion of the flow 22 causes a residual flash gas to form in the flow 42, downstream from the final expansion valve. The molar content of flash gas in the flow 42 is for example greater than 5%, and is in particular comprised between 4% and 10%.

The flow 42 is next introduced into the flash end separation flask 26 to recover, at the bottom of the separation flask 26, a liquid stream 46 of liquefied natural gas, and at the head of the separation flask 26, a gaseous stream 48 of flash gas.

The liquid stream 46 is then conveyed toward a storage tank 28. In the example shown in FIG. 1, the stream 46 is pumped through a pump 50. Alternatively, it flows by gravity in the tank 28, without being pumped.

During its transport, and its introduction into the tank 28, a residual boil-off gas forms from the liquid stream 46, in particular by reheating the liquid stream 46 in the transport pipes, through the heat intakes of the tank(s) 28 and/or under the effect of a pressure difference between the separation flask 26 and the tank 28.

A gaseous stream 52 of boil-off gas is recovered at the head of the tank 28. The gaseous stream of boil-off gas 52 is reheated in the downstream expander 40, for example to a temperature greater than −60° C.

The gaseous stream 48 or flash gas is reheated in the additional expander 41, for example to a temperature greater than −60° C.

It is next mixed with the gaseous stream 52 of boil-off gas to form a mixed gas flow 54.

The gaseous stream 48 represents between 30 mol % and 80 mol % of the mixed gas flow 54.

The mixed gas flow 54 is next introduced into the compression apparatus 30 to form a flow of compressed combustible gas 32.

In the example shown in FIG. 1, the flow 54 successively passes through a first compressor 56, a first air cooler exchanger or a water exchanger 58 to be cooled to ambient temperature, a second compressor 60, then a second exchanger 62 to be cooled again to ambient temperature or the temperature of the water.

The pressure of the flow of compressed combustible gas 32 is for example above 25 bars, and is in particular comprised between 5 bars and 70 bars.

In one particular example, the composition of the flow 32 typically consists of 15 mol % nitrogen and 85 mol % methane.

The flow of compressed combustible gas 32 is then recovered to be used as fuel in the plant 12, or as backup fluid in this plant 12.

A bypass flow 36 is withdrawn in the flow of combustible gas 32. The molar flow rate of the bypass flow 36 is for example greater than 10% of the molar flow rate of the flow of combustible gas 32 derived from the compression apparatus 30, and is in particular comprised between 10% and 100% of this flow rate.

The bypass flow 36 is next compressed in the compressor 34, then is cooled to ambient temperature in the air cooler exchanger or the water exchanger 64, to form a compressed bypass flow 66.

The pressure of the compressed bypass flow 66 is for example above 30 bars at the pressure of the flow 32.

The flow 66 is next introduced into the downstream heat exchanger 40 to be sub-cooled therein to a temperature advantageously below −50° C.

It is next expanded in the dynamic expansion turbine 38, to a pressure below 2 bars, and is in particular comprised between 1.1 bar and 3 bars, to form an expanded bypass flow 68.

The temperature of the flow 68 is preferably below −150° C., and is in particular comprised between −140° C. and −160° C.

The expanded bypass flow 68 is optionally at least partially liquid. In this case, the molar content of liquid in the flow 68 is typically less than 15 mol %. Alternatively, the flow 68 remains completely gaseous.

In this example, the entire expanded bypass flow 68 forms a first stream 70 that is next introduced into the downstream heat exchanger 40 to be reheated therein. The temperature of the first reheated stream 71 is advantageously greater than −60° C.

The first reheated stream 71 is next reintroduced into the mixed flow 54, downstream from the flash end separation flask 26, and upstream from the compression apparatus 30.

In this embodiment, at least one gaseous flow of treated gas 72 derived from the plant 12 is tapped toward the plant 10.

The gaseous flow 72 has a pressure for example exceeding 60 bars, and in particular comprised between 40 bars and 90 bars. The temperature of the gaseous flow is typically equal to the ambient or pre-cooled temperature.

The gaseous flow 72 has a molar methane content greater than 80%, and a molar $C_4^+$ content below 5%.

The molar flow rate of the gaseous flow 72 can represent up to 10% of the flow rate of the initial natural gas load introduced into the liquefaction plant 12.

The gas flow 72 is next separated into a first part 74 and a second part 76.

The molar flow rate of the first part 74 of the gaseous flow 72 for example constitutes between 20 mol % and 50 mol % of the gaseous flow 72 and the molar flow rate of the second part 76 of the gaseous flow 72 for example constitutes between 50% and 80% of the molar flow rate of the gaseous flow 72.

The first part 74 of the gaseous flow 72 is next introduced into the downstream heat exchanger 40 to be cooled and liquefied therein by heat exchange, in particular with the expanded bypass flow 68, to a temperature advantageously below −150° C.

The first part 74 next passes through a control valve 78, before being mixed with the flow of expanded liquefied natural gas 42 derived from the expansion device 24.

The second part 76 of the gaseous flow 72 is introduced into the additional heat exchanger 41 to be cooled and liquefied therein by heat exchange with the flash gas gaseous stream 48, to a temperature advantageously below −150° C.

The second part 76 next passes through a control valve 80, before being mixed with the flow of expanded liquefied natural gas 42 derived from the expansion device 24.

The implementation of the method according to the invention is therefore particularly simple, since it decreases the number of pieces of equipment necessary to perform a flash of the liquefied natural gas for storage thereof, and advantageously to recover the flash gases and boil-off gases produced.

In particular, a single compression apparatus 30 is used to compress a mixed flow 54 formed from flash gases and boil-off gases.

The use of a bypass flow 36 withdrawn in the combustible flow 32 formed at the outlet of the compression apparatus 30 makes it possible to obtain a very effective thermal integration, and to benefit from the frigories available to liquefy the gas treated in the plant 12 at least partially.

The thermal integration of the bypass flow 36 makes it possible to adjust the frigories between the different operating modes of the plant 10, between the tub filling phases, and the methane tanker loading phases.

The method according to the invention and the plant 10 allowing it to be carried out are therefore particularly suitable for a floating unit, such as a FLNG.

In one alternative, shown schematically in FIG. 1, a part 90 of the gaseous stream of boil-off gas is sent toward other liquefaction trains. Conversely, a flow of liquefied natural gas 92 coming from other liquefaction trains is introduced into the tank 28.

Figure 2:
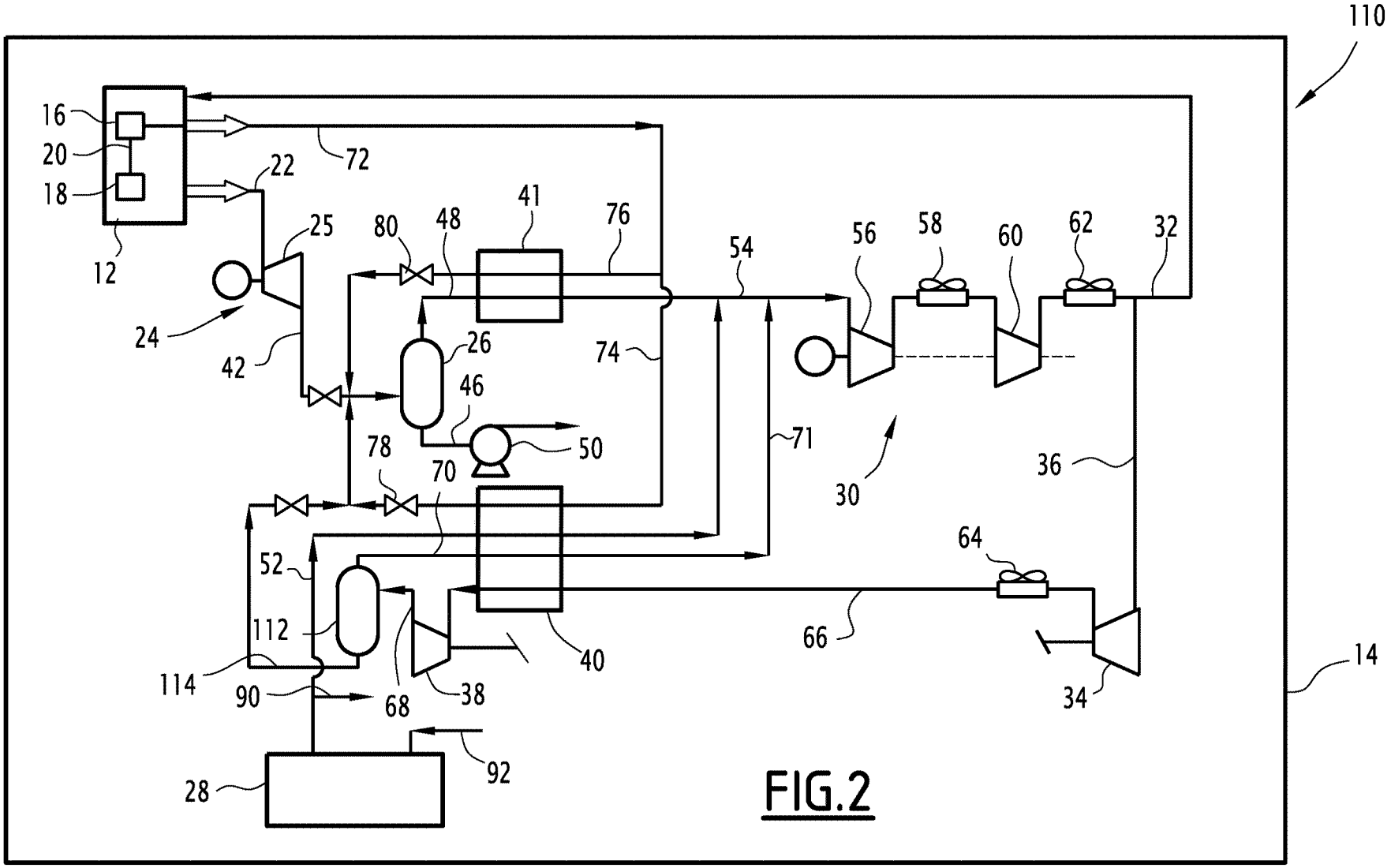
FIGS. 2 to 6 are block diagrams of alternative plants intended to implement variant methods according to the invention.

A second plant 110 according to the invention is illustrated by FIG. 2. The second plant 110 differs from the first plant 10 in that it comprises a downstream separation flask 112, placed at the outlet of the dynamic expansion turbine 38.

The expanded bypass flow 68 is introduced into the downstream separation flask 112 to recover, at the head, the first stream 70 in gaseous form, and at the bottom, a second liquid stream 114.

The molar flow rate of the second stream 114 for example constitutes between 10% and 15% of the molar flow rate of the expanded bypass flow 68.

Like before, the first stream 70 is introduced into the downstream heat exchanger 40 to be heated by heat exchange in particular with the first part 74 of the gaseous flow 72 of treated gas.

The second stream 114 is reintroduced into the flow of expanded liquefied natural gas 42 derived from the expansion apparatus 24, upstream from the flash end separation flask 26.

The second method according to the invention optimizes the distribution of the liquid in the downstream heat exchanger 40.

Figure 3:
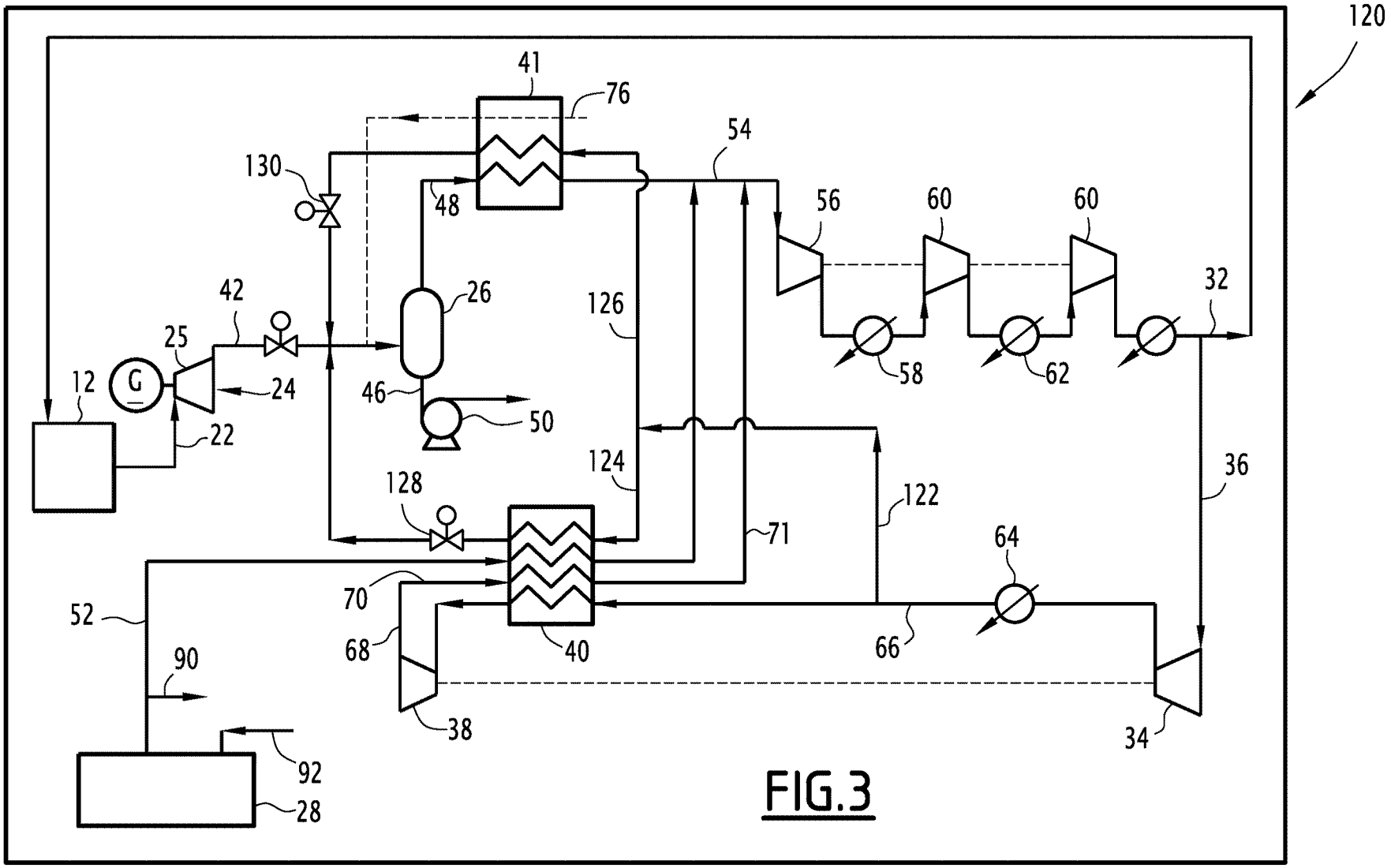

A third plant 120, intended to carry out a third method according to the invention, is illustrated by FIG. 3.

Unlike the first method carried out in the plant 10 described in FIG. 1, a recirculation flow 122 is withdrawn in the compressed bypass flow 66.

The recirculation flow 122 for example represents between 30% and 80% of the compressed bypass flow 66 derived from the compressor 34.

The recirculation flow 122 is next separated into a first part 124 and a second part 126.

The molar flow rate of the first part 124 of the recirculation flow 122 for example constitutes between 20 mol % and 50 mol % of the recirculation flow 122 and the molar flow rate of the second part 126 of the recirculation flow 122 for example constitutes between 50% and 80% of the molar flow rate of the recirculation flow 122.

The first part 124 of the recirculation flow 122 is introduced into the downstream heat exchanger 40 to be cooled therein, and optionally at least partially liquefied, by heat exchange, in particular with the expanded bypass flow 68, to a temperature advantageously below −150° C.

The first part 124 next passes through a control valve 128, before being mixed with the flow of expanded liquefied natural gas 42 derived from the expansion device 24.

The second part 126 of the bypass flow 122 is introduced into the additional heat exchanger 41 to be cooled and optionally at least partially liquefied therein by heat exchange with the flash gas gaseous stream 48, to a temperature advantageously below −150° C.

The second part 126 next passes through a control valve 130, before being mixed with the flow of expanded liquefied natural gas 42 derived from the expansion device 24.

The use of a bypass flow 36 withdrawn in the combustible flow 32 formed at the outlet of the compression apparatus 30 makes it possible to obtain a very effective thermal integration, and to benefit from the frigories available to liquefy, at least partially, a recirculation flow 122 derived from the bypass flow, when excess flash gas and/or boil-off gas occurs.

In an alternative shown in dotted lines in FIG. 3, at least part 76 of the gaseous flow of treated gas 72 derived from the plant 12 is also introduced into the additional heat exchanger 41, as described above for FIG. 2.

Figure 4:
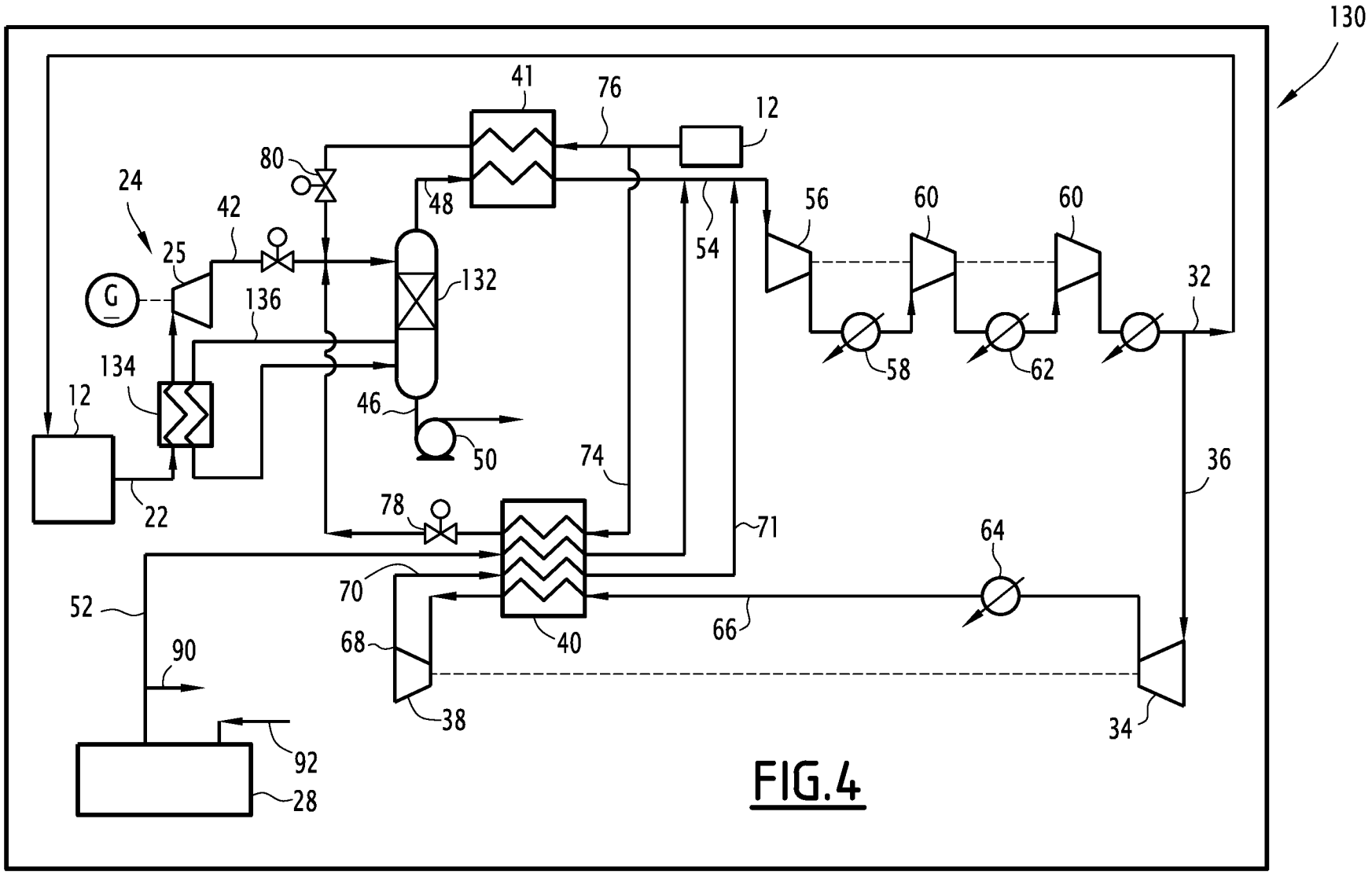

A fourth plant 130, intended to carry out a fourth method according to the invention, is illustrated by FIG. 4.

This plant 130 differs from the plant 10 shown in FIG. 1 in that the flash end separation flask 26 is replaced by a flash end distillation column 132.

A re-boiling exchanger 134 is positioned upstream from the expansion device 24 to place the flow of liquefied natural gas 22 in a heat exchange relationship with a re-boiling flow 136 derived from the column 132.

The implementation of the fourth method according to the invention is also similar to that of the first method according to the invention.

Figure 5:
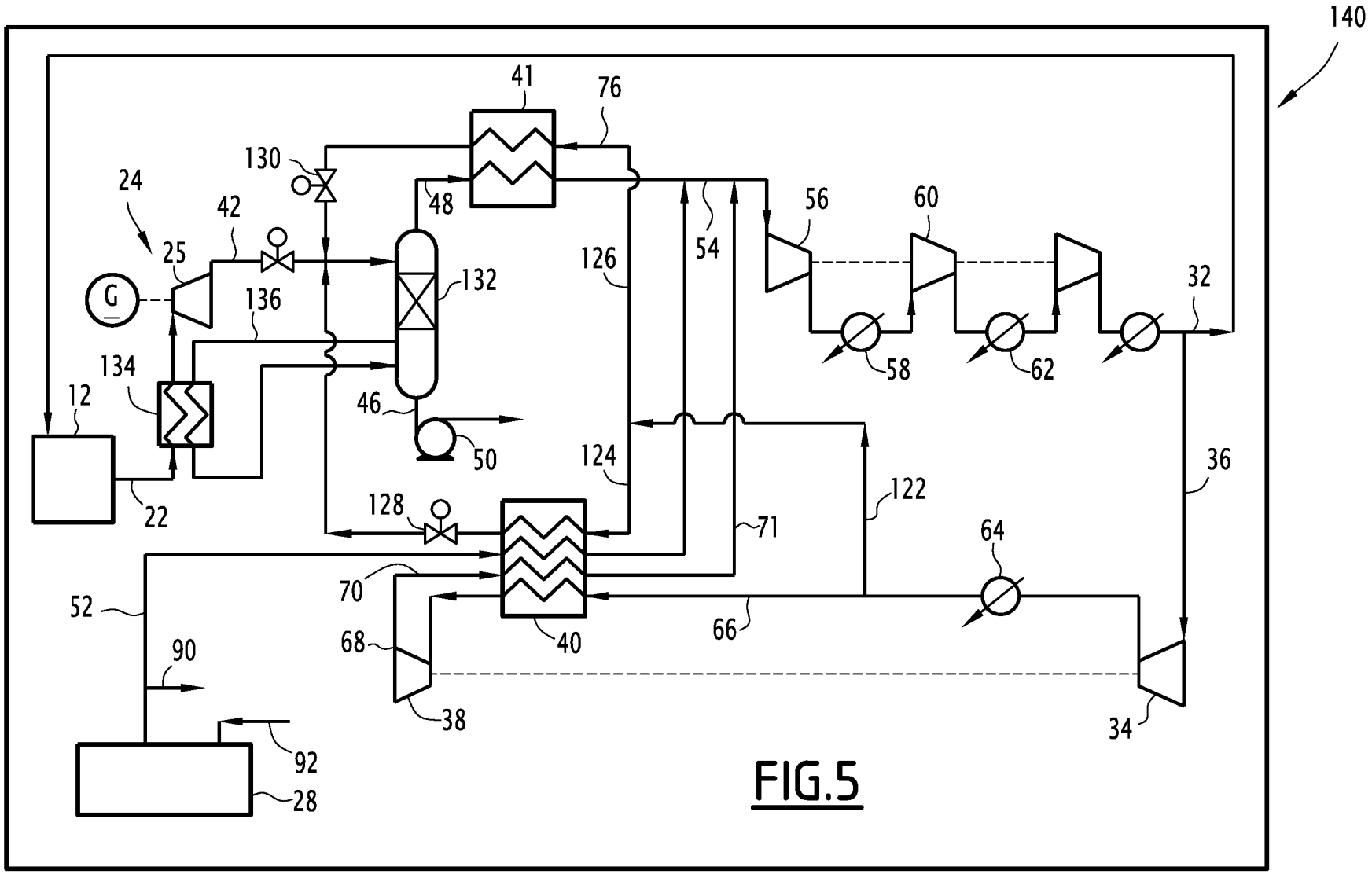

A fifth plant 140, intended to carry out a fifth method according to the invention, is illustrated by FIG. 5.

This plant 140 differs from the plant 120 shown in FIG. 3 in that the flash end separation flask 26 is replaced by a flash end distillation column 132.

The implementation of the fifth method according to the invention is also similar to that of the third method according to the invention.

Figure 6:
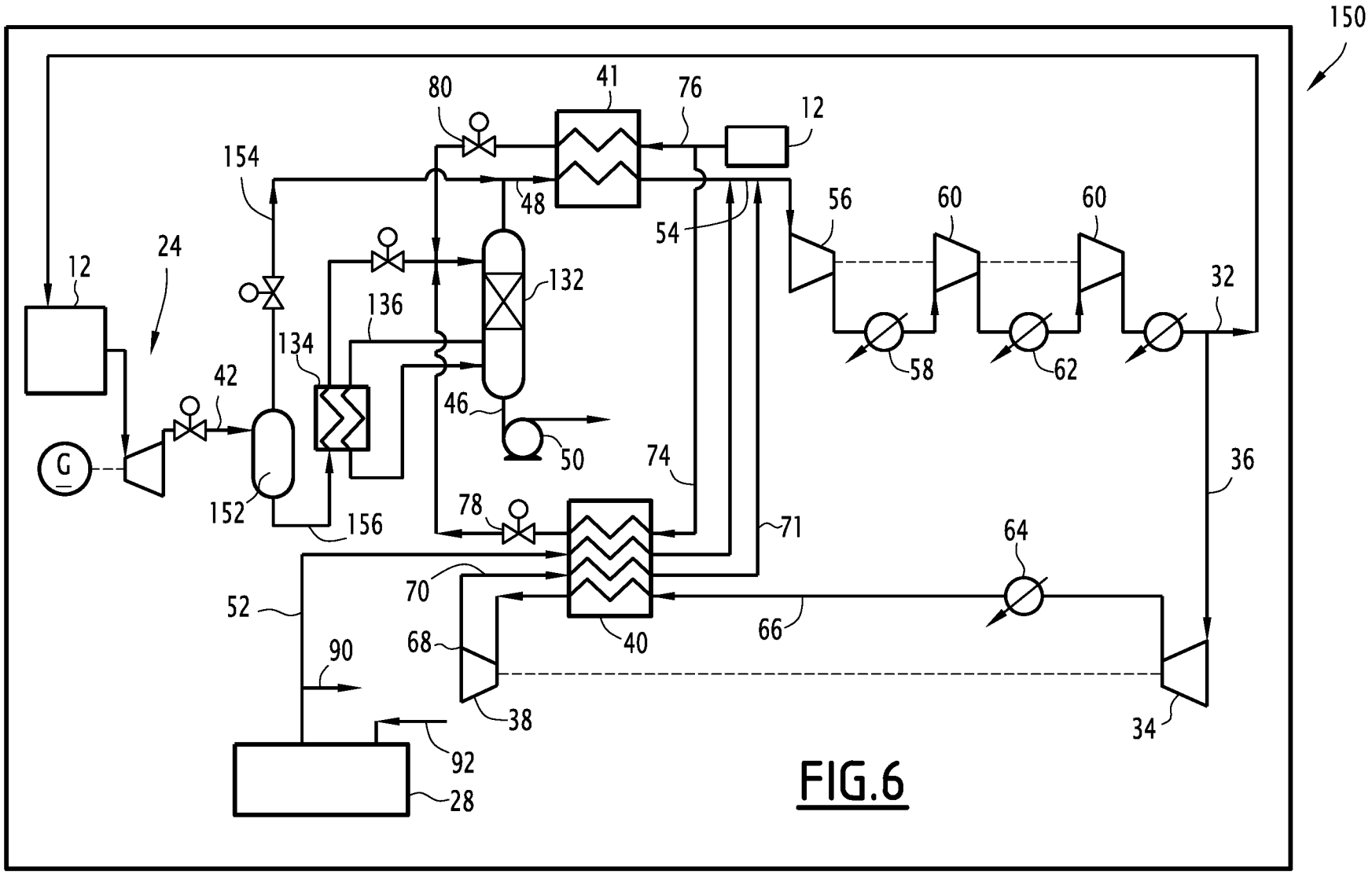

A sixth plant 150, intended to carry out a sixth method according to the invention, is illustrated by FIG. 6.

The sixth plant 150 differs from the fourth plant 130 by the insertion of an intermediate flask 152 between the outlet of the expansion device 24 and the inlet of the distillation column 132.

The intermediate flask 152 receives the flow of expanded liquefied natural gas 42 and separates it into a head stream 154, mixed with the gaseous stream 48 of flash gas, and a bottom stream 156, introduced into the re-boiling exchanger 134 before reaching the distillation column 132.

This plant 150 is beneficial for recovering helium in the case where the gaseous stream 154 is rich in helium, typically made up of at least 25% helium, and can therefore advantageously be sent into a helium purification plant.

In alternatives of each of the plants 120 to 150, a downstream flask 112 is provided to separate the expanded bypass flow 68, as described in the second method according to the invention.

In an alternative of the plants described above, the dynamic expansion turbine 25 of the expansion device 24 is replaced by a static expansion valve. The flow of liquefied natural gas then undergoes a static, and not dynamic, expansion in the expansion device 24.

The method according to the invention and the corresponding plant are therefore particularly suitable for managing the significant temperature and flow rate variations of the stream of boil-off gas 52 coming from the tank 28 between the loading phases of a methane tanker by emptying the tank and the filling phases of the tank.

As indicated above, the thermal integration of the bypass flow 36 with the boil-off gas flow 52 is used to adjust the necessary frigories, and to vary the relative flow rates of the flow of combustible gas 32 and the bypass flow 36.

This is obtained without having to modify operating parameters for the liquefaction of the natural gas, in particular in the main liquefaction cycles.

The invention claimed is:

1. A process for expansion and storage of a flow of liquefied natural gas from a natural gas liquefaction plant, comprising:

flash expanding the flow of liquefied natural gas in an expander to form a flow of expanded liquefied natural gas;

bringing the flow of expanded liquefied natural gas into a flash end capacitor;

recovering, at the bottom of the flash end capacitor, a liquid stream of liquefied natural gas;

conveying the liquid stream of liquefied natural gas into at least one liquefied natural gas tank;

withdrawing, at the head of the flash end capacitor, a gaseous stream of flash gas;

recovering, at the head of the liquefied natural gas tank, a gaseous stream of boil-off gas;

mixing the gaseous stream of flash gas and the gaseous stream of boil-off gas to form a mixed gaseous flow;

compressing the mixed gaseous flow in at least one compressor to form a flow of compressed combustible gas;

withdrawing a bypass flow in the flow of compressed combustible gas;

compressing the bypass flow in at least one downstream compressor to form a compressed bypass flow;

cooling the compressed bypass flow;

expanding the compressed bypass flow to form an expanded bypass stream;

reheating at least a first stream derived from the expanded bypass flow in at least one downstream heat exchanger, reintroducing the first reheated stream in the mixed gaseous flow and/or in at least one of the gaseous stream of boil-off gas and the gaseous stream of flash gas, upstream from the at least one compressor introducing the boil-off gas stream into the downstream heat exchanger to be placed in a heat exchange relationship with the first stream;

wherein the flow of compressed combustible gas is recovered and used as fuel in the plant.

2. The process according to claim 1, comprising introducing the at least partially liquid expanded bypass stream into a downstream separation flask, withdrawing, at the head of the downstream separation flask, the first stream as a gas, and reintroducing the first stream in the mixed gaseous flow and/or in at least one of the gaseous stream of boil-off gas and the gaseous stream of flash gas, upstream from the at least one compressor;

recovering, at the bottom of the downstream separation flask, a second liquid bypass stream, and introducing the liquid bypass stream into the expanded liquefied natural gas flow, upstream from the flash end capacitor.

3. The process according to claim 1, wherein the entire expanded bypass flow constitutes the first stream.

4. The process according claim 1, comprising introducing the compressed bypass flow derived from the downstream compressor into the downstream heat exchanger to be placed in a heat exchange relationship with the first stream.

5. The process according to claim 1, comprising:

providing a flow of treated natural gas intended to be liquefied;

introducing at least a first part of the flow of treated natural gas into the downstream heat exchanger to be placed in a heat exchange relationship with the first stream;

at least partially liquefying the first part of the flow of treated natural gas into the downstream heat exchanger by heat exchange with the first stream.

6. The process according to claim 5, comprising introducing the first part of the flow of liquefied treated natural gas into the flow of expanded liquefied natural gas derived from the expander, upstream from the flash end capacitor.

7. The process according to claim 5, comprising:

separating the flow of treated natural gas into the first part of the flow of treated natural gas and a second part of the flow of treated natural gas;

introducing at the second part of the flow of treated natural gas into an additional heat exchanger, to be placed in a heat exchange relationship with the stream of flash gas;

liquefying the second part of the flow of treated natural gas in the additional heat exchanger by heating the stream of flash gas;

introducing the second part of the flow of liquefied treated natural gas into the flow of expanded liquefied natural gas derived from the expander, upstream from the flash end capacitor.

8. The process according to claim 1, comprising:

tapping a recirculation flow into the flow of compressed gas;

liquefying at least part of the recirculation flow in the downstream heat exchanger by heat exchange with the first stream.

9. The process according to claim 1, wherein the flash end capacitor is a flash end separation flask or a flash end distillation column.

10. The process according to claim 1, wherein the expander comprises a dynamic expansion turbine.

11. A plant for the expansion and storage of a flow of liquefied natural gas from a natural gas liquefaction plant, comprising:

an expander configured to carry out a flash expansion of the flow of liquefied natural gas to form a flow of expanded liquefied natural gas;

a flash end capacitor configured to receive the flow of expanded liquefied natural gas coming from the expander;

an outlet for recovering, at the bottom of the flash end capacitor, a liquid stream of liquefied natural gas;

at least one liquefied natural gas tank and conveyor for conveying the liquid stream of liquefied natural gas into the liquefied natural gas tank;

an outlet for withdrawing, at the head of the flash end capacitor, a gaseous stream of flash gas;

an outlet for recovering, at the head of the liquefied natural gas tank, a gaseous stream of boil-off gas;

a mixer for mixing the gaseous stream of flash gas and the gaseous stream of boil-off gas to form a mixed gaseous flow;

at least one compressor able to compress the mixed gaseous flow to form a flow of compressed combustible gas;

an outlet for withdrawing a bypass flow in the flow of compressed combustible gas;

at least one downstream compressor for compressing the bypass flow and forming a compressed bypass flow;

a downstream heat exchanger for cooling the compressed bypass flow to form an expanded bypass stream;

an expander for at least partially expanding the compressed bypass flow and/or a liquefier for at least partially liquefying the compressed bypass flow;

an inlet for introducing at least a first stream derived from the expanded bypass flow in the downstream heat exchanger, to allow reheating of the first stream, an inlet for reintroducing the first stream in the mixed gaseous flow and/or in at least one of the gaseous stream of boil-off gas and the gaseous stream of flash gas, upstream from the compressor;

a downstream separation flask;

an outlet for withdrawing, at the head of the downstream separation flask, the first stream as a gas, and an inlet for reintroducing the first stream in the mixed gaseous flow and/or in at least one of the gaseous stream of boil-off gas and the gaseous stream of flash gas, upstream from the compressor; and an outlet for recovering, at the bottom of the downstream separation flask, a second liquid bypass stream, and an inlet for introducing the liquid bypass stream into the expanded liquefied natural gas flow, upstream from the flash end separation flask.

12. The plant according to claim 11, wherein the first stream consists of the entire expanded bypass flow.

13. The plant according to claim 11, wherein the downstream heat exchanger is configured to put in a heat exchange relationship the first stream, and at least part of a flow of treated gas intended to be liquefied.

14. The plant according to claim 11, comprising:

an outlet for tapping a recirculation flow from the compressed bypass flow; and an inlet for introducing at least part of the recirculation flow in the downstream heat exchanger to liquefy the at least part of the recirculation flow at least partially in the downstream heat exchanger.

* * * * *